US007419390B2

(12) United States Patent
Ohtaka et al.

(10) Patent No.: US 7,419,390 B2
(45) Date of Patent: Sep. 2, 2008

(54) CONNECTOR STRUCTURE

(75) Inventors: Kazuto Ohtaka, Makinohara (JP); Takashi Kojima, Makinohara (JP); Toshiharu Takahashi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/651,066

(22) Filed: Jan. 9, 2007

(65) Prior Publication Data

US 2007/0184692 A1 Aug. 9, 2007

(30) Foreign Application Priority Data

Jan. 11, 2006 (JP) ..... 2006-003840

(51) Int. Cl.
*H01R 13/62* (2006.01)

(52) U.S. Cl. ..... 439/157; 439/372

(58) Field of Classification Search ..... 439/157, 439/372, 757

See application file for complete search history.

(56) References Cited

U.S. PATENT DOCUMENTS 5,609,494 A * 3/1997 Yamaguchi et al. ..... 439/157
6,623,287 B2 * 9/2003 Hatagishi et al. ..... 439/157
6,881,081 B2 * 4/2005 Gundermann et al. ..... 439/157

FOREIGN PATENT DOCUMENTS

JP 09-120859 A 5/1997

* cited by examiner

*Primary Examiner*—Thanh-Tam T Le
(74) *Attorney, Agent, or Firm*—Sughrue Mion, PLLC

(57) ABSTRACT

A lever is rotatably mounted on an inner housing of a female connector and assists a fitting operation through engagement of an engagement portion of a locking arm of the female connector with an engagement projection of a male connector and a fitting canceling operation in association with rotation thereof. An opening in the lever allows the tip of a finger of an operator to be brought into contact with an operation access portion of the locking arm so as to press the operation access portion, and a lever locking canceling finger catch portion of the lever is located in a position and formed into a shape which allow the finger of the operator to be hooked thereon such that the tip of the finger is in contact with the operation access portion of the locking arm.

4 Claims, 10 Drawing Sheets

CONNECTOR STRUCTURE

BACKGROUND OF THE INVENTION

1. Field of the Invention

The present invention relates to a connector structure in which a pair of male and female connectors are fitted together.

2. Related Art

Conventionally, lever type connectors have been known (refer to, for example, JP-A-9-120859). FIG. 10 is an exploded perspective view which shows a lever type connector disclosed in JP-A-9-120859.

Referring to FIG. 10, in a lever type connector 100, a rotating lever 101 is supported on a connector main body 120 of a male side connector 110 in such a manner as to rotate about support pins 121 of the connector main body 120 by allowing the support pins 121 to be fitted in shaft holes 102 in the rotating lever 101.

While assisting the connector main body 120 of the male side connector 110 in performing a fitting operation into a female side connector 130 as it rotates, the rotating lever 101 brings the individual connectors 110, 130 into a state where the connectors are fitted in or on each other. Namely, the female side connector 130 is accommodated and fitted in a hood portion of the connector main body 120 of the male side connector 110, and cam pins 131 which are provided on an external surface of the female side connector 130 in such a manner as to project therefrom are fitted, respectively, in cam grooves 103 formed on the rotating lever 101 via cuts 122*a* formed through the hood portion 122. In addition, an engagement claw 105 provided on a base portion 104 of the rotating lever 101 in such a manner as to project therefrom is fitted in an engagement hole 123*a* in a locking projection 123 which is provided on the connector main body 120 of the male side connector 110. By this configuration, the fitted state of the connectors 110, 130 are maintained via the rotating lever 101.

With the conventional lever type connector 100 shown in FIG. 10, since the rotating lever 101 functioned to bring the connectors 110, 130 into the state where they were fitted in or on each other, when the rotating lever 101 failed, there was caused a problem that the fitted state of the connectors 110, 130 could not be maintained any longer.

Then, a fitting mechanism (not shown) for causing the connectors 110, 130 to be fitted in or on each other can be provided separately from the rotating lever 101 which brings the connectors 110, 103 into the fitted state. According to the configuration like this, even though the rotating lever fails, the fitted state of the connectors can be maintained by the fitting mechanism.

On the other hand, however, when canceling the fitting of the connectors, separately from a canceling operation of the fitting of the connectors by means of the lever, an additional operation of canceling the fitting of the connectors by means of the fitting mechanism needed to be performed. Therefore, there were caused problems that the operating procedure became complicated and troublesome and that there was caused a fear that due to the complicated and troublesome operating procedure, a failure to follow the operating procedure would occur, which would trigger a failure of constituent members of the connectors. Namely, for example, when the fitting of the connectors was canceled by the lever while having failed to perform the canceling operation of the fitting by the fitting mechanism of the connectors, there was a fear that the fitting mechanism would fail by virtue of the toggle effect of the lever.

SUMMARY OF THE INVENTION

The invention was made in view of the situations, and an object thereof is to provide a connector structure which can enable the fitting of connectors with a low inserting force by a lever, avoid a complicated and troublesome operating procedure for canceling the fitting of the connectors while allowing a locking arm to hold the connectors in a fitted state, and prevent a failure to follow the operating procedure which would otherwise occur due to the procedure becoming complicated and troublesome and a failure of constituent members of the connectors which would otherwise occur due to the failure to follow the operating procedure.

1) According to the invention, there is provided a connector structure comprising:

a first connector including a locking arm having an engagement portion; and a second connector including an engagement projection, wherein housings of the first and second connectors are fitted together through engagement of the engagement portion with the engagement projection, wherein a lever rotatably provided on the connector housing of the first connector to perform a fitting operation and a fitting canceling operation in association with rotation thereof, an operation access portion is provided on the locking arm which is to be pressed to deflect the locking arm so that the engagement portion is released from the engagement projection, and the operation access portion is disposed in a position such that the operation access portion is able to be pressed prior to the fitting canceling operation in association with the rotation of the lever and the rotating operation of the lever can be subsequently performed continuously.

With the connector structure, when canceling the fitting of the housings of the first and second connectors, the operation access portion of the locking arm is pressed prior to the fitting canceling operation which is brought about by the rotation of the lever, whereby the engaged state of the engagement portion on the locking arm with the engagement projection on the connector housing of the second connector is canceled. From this state, the lever is operated to be rotated as a continuous operation from the pressing operation of the operation access portion of the locking arm. Thus, the connector structure can be obtained in which the fitting of the connector housings of the first and second connectors is canceled through the series of operations described above.

2) According to the connector structure of the invention, an opening may be provided on the lever in a predetermined position which corresponds to the operation access portion on the locking arm, so that the operation access portion is pressed via the opening prior to a fitting canceling operation in association with a rotation of the lever.

With the connector structure, when canceling the fitting of the housings of the first and second connectors, the operation access portion of the locking arm is pressed via the opening in the lever prior to the fitting canceling operation which is brought about by the rotation of the lever, whereby the engagement of the engagement portion on the locking arm with the engagement projection on the connector housing of the second connector is canceled. From this state, the lever is operated to be rotated as a continuous operation from the pressing operation of the operation access portion of the locking arm. Thus, the connector structure can be obtained in which the fitting of the connector housings of the first and second connectors is canceled through the series of operations described above. In addition, since only the opening is provided in the lever, the reduction in strength of the lever can be prevented. Additionally, the protection of the locking arm by the lever also becomes possible.

According to the connector structure of the invention, a finger catch portion for canceling locking of the lever may be provided on the lever, and the finger catch portion may be formed into a predetermined shape at a predetermined position so that the finger of an operator to be hooked thereon while a tip of the finger is in contact with the operation access portion of the locking arm.

With the connector structure, when canceling the fitting of the housings of the first and second connectors, the operation access portion of the locking arm is pressed via the opening in the lever prior to the fitting canceling operation by the rotation of the lever, whereby the engaged state of the engagement portion of the locking arm with the engagement projection on the connector housing of the second connector is canceled.

As this occurs, the tip of the finger of the operator which is in contact with the operation access portion of the locking arm via the opening in the lever is such that it is naturally hooked on the lever locking canceling finger catch portion of the lever, and as a continuous operation from the pressing operation of the operation access portion of the locking arm, the finger tip proceeds from that state to perform a rotating operation of the lever, so as to rotate the lever. Thus, the connector structure can be obtained in which the fitting of the connector housings of the male and female connectors is canceled through the series of operations described above.

DETAILED DESCRIPTION OF THE PREFERRED EMBODIMENTS

Hereinafter, the invention will be described by reference to an embodiment which is illustrated in the accompanying drawings.

Figure 1:
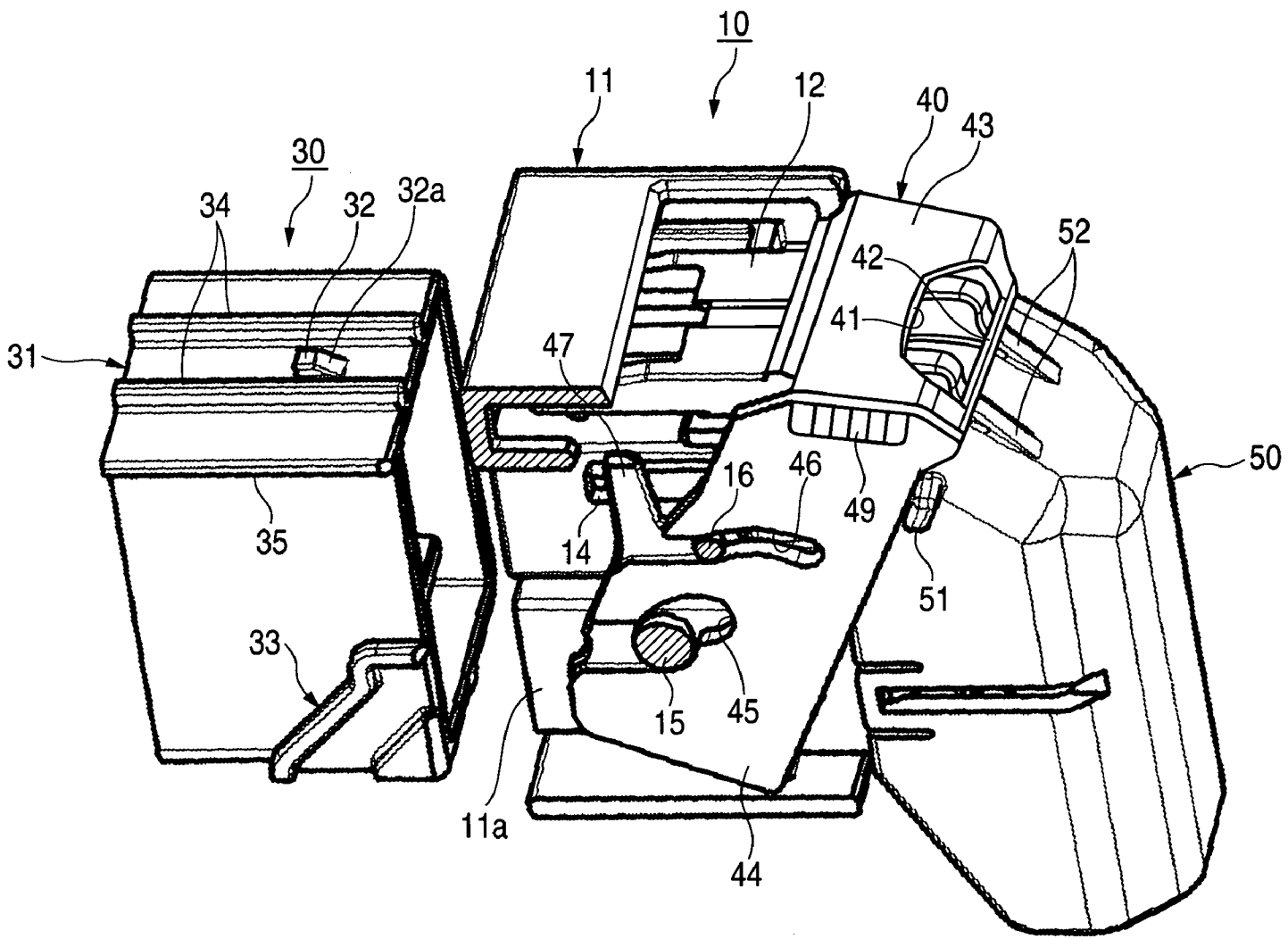
FIG. 1 is a perspective view of a connector structure according to an embodiment of the invention with an outer housing removed therefrom which shows a state in which a male connector has not yet been fitted in a female connector.
Figure 2:
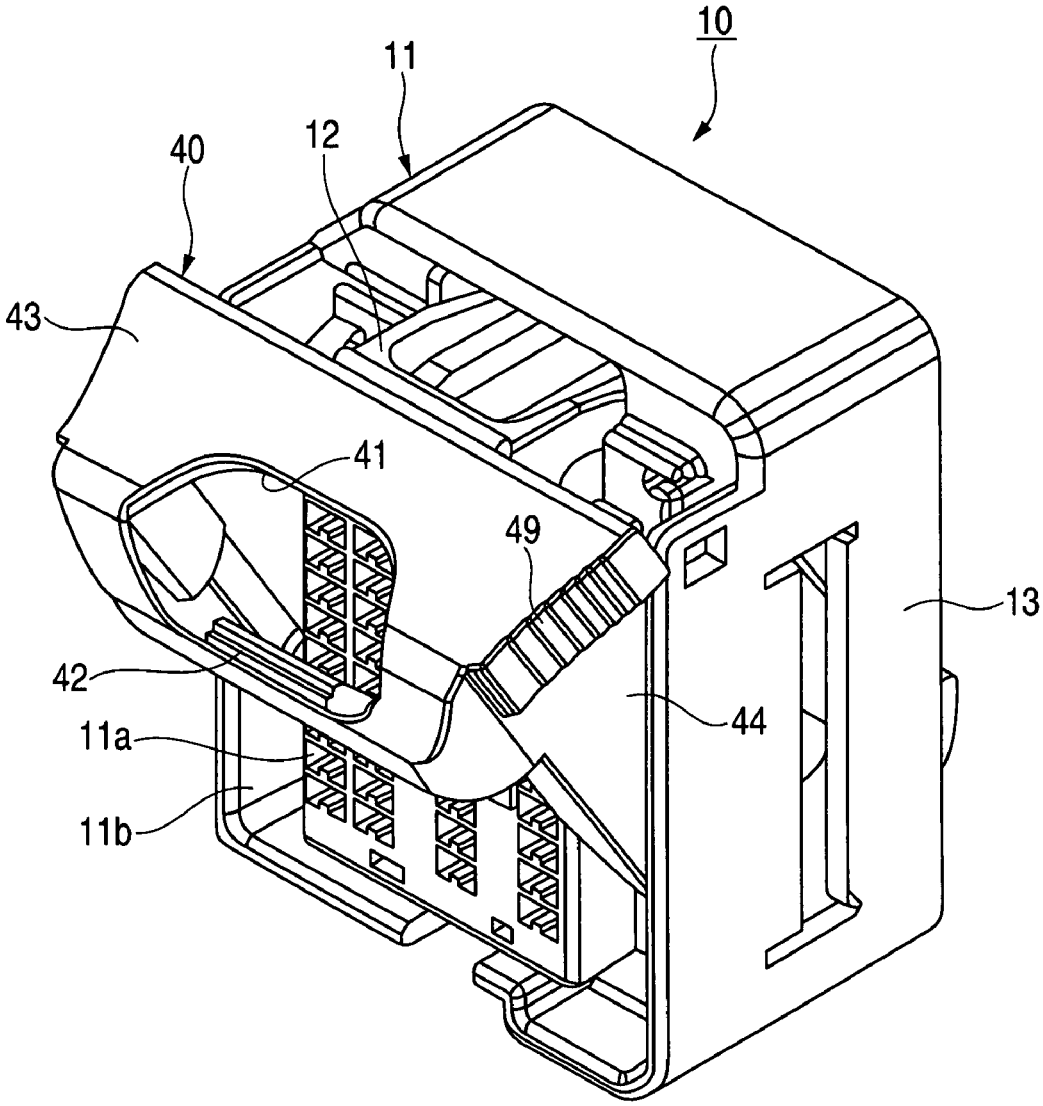
FIG. 2 is a perspective view of the female connector of the connector structure in FIG. 1 which shows a state resulting before a lever thereof performs a fitting operation.

FIG. 1 is a perspective view of a connector structure according to an embodiment of the invention with an outer housing removed therefrom which shows a state in which a male connector has not yet been fitted in a female connector, and FIG. 2 is a perspective view of the female connector of the connector structure in FIG. 1 which shows a state resulting before a lever thereof performs a fitting operation.

Figure 3:
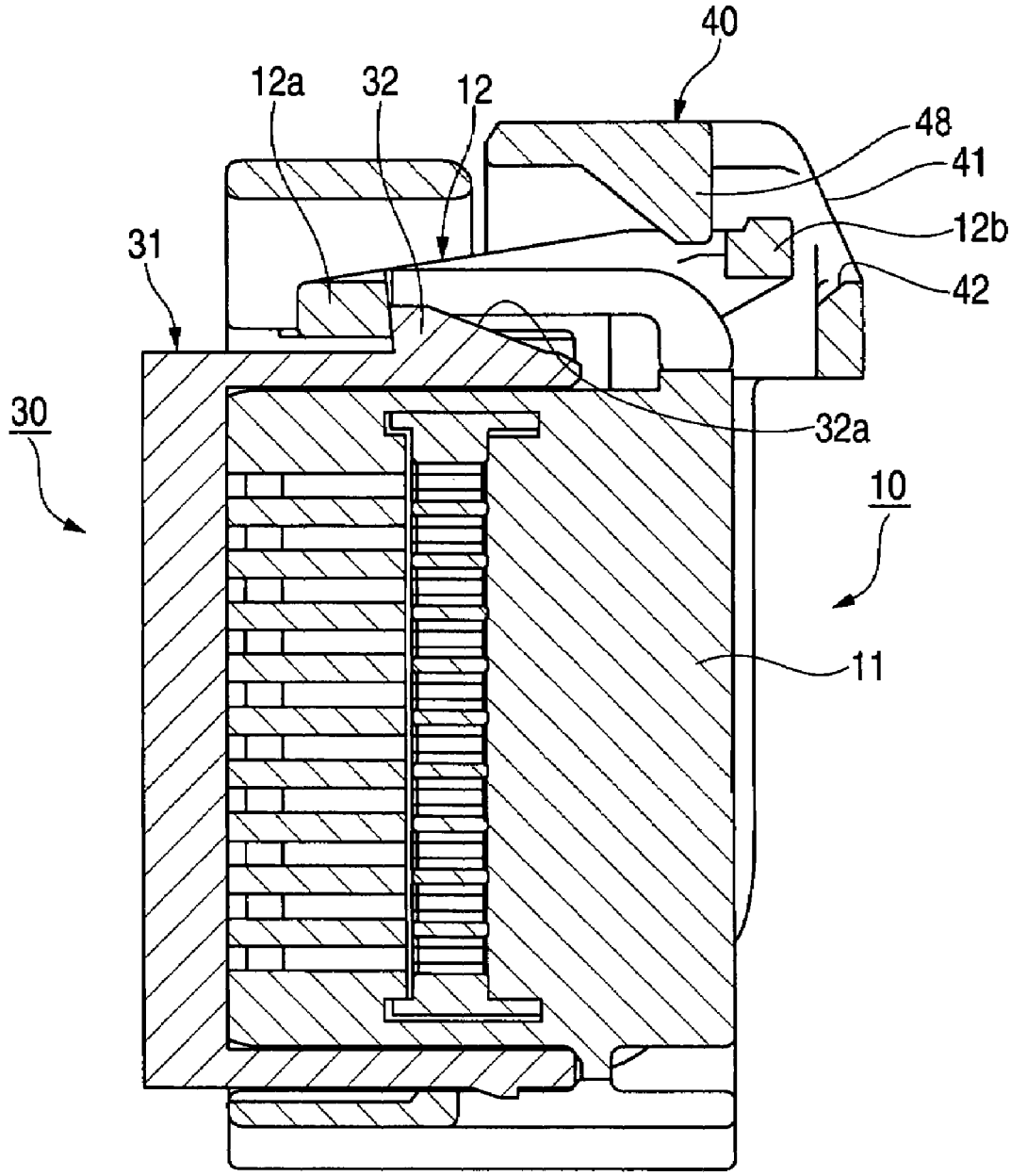
FIG. 3 is a sectional view of the connector structure shown in FIG. 1 with the cover removed therefrom and the male connector fitted in the female connector which shows a sectional view taken in a position where a locking arm becomes visible such that the lever has performed the fitting operation.
Figure 4:
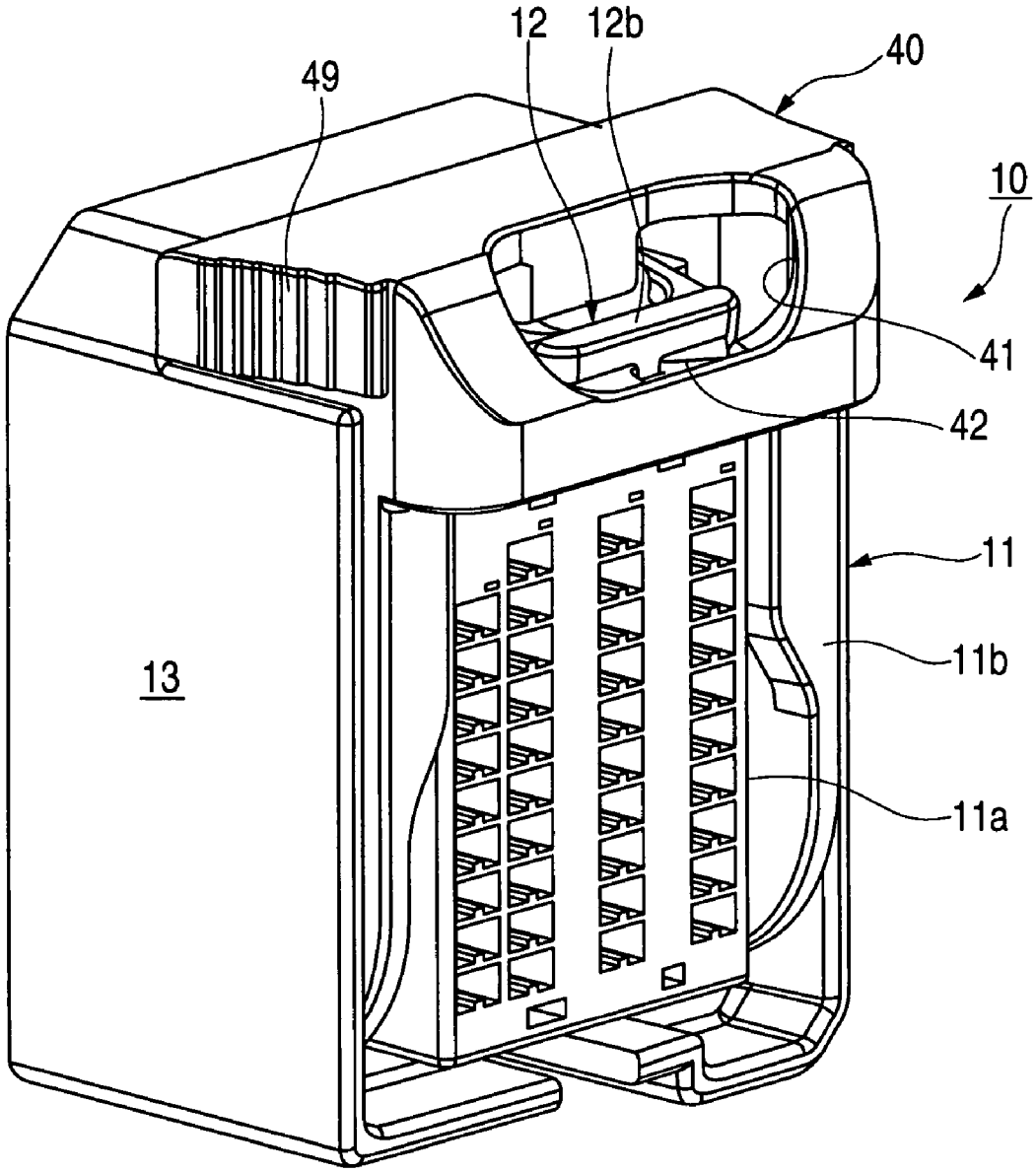
FIG. 4 is a perspective view of the connector structure shown in FIG. 3.
Figure 5:
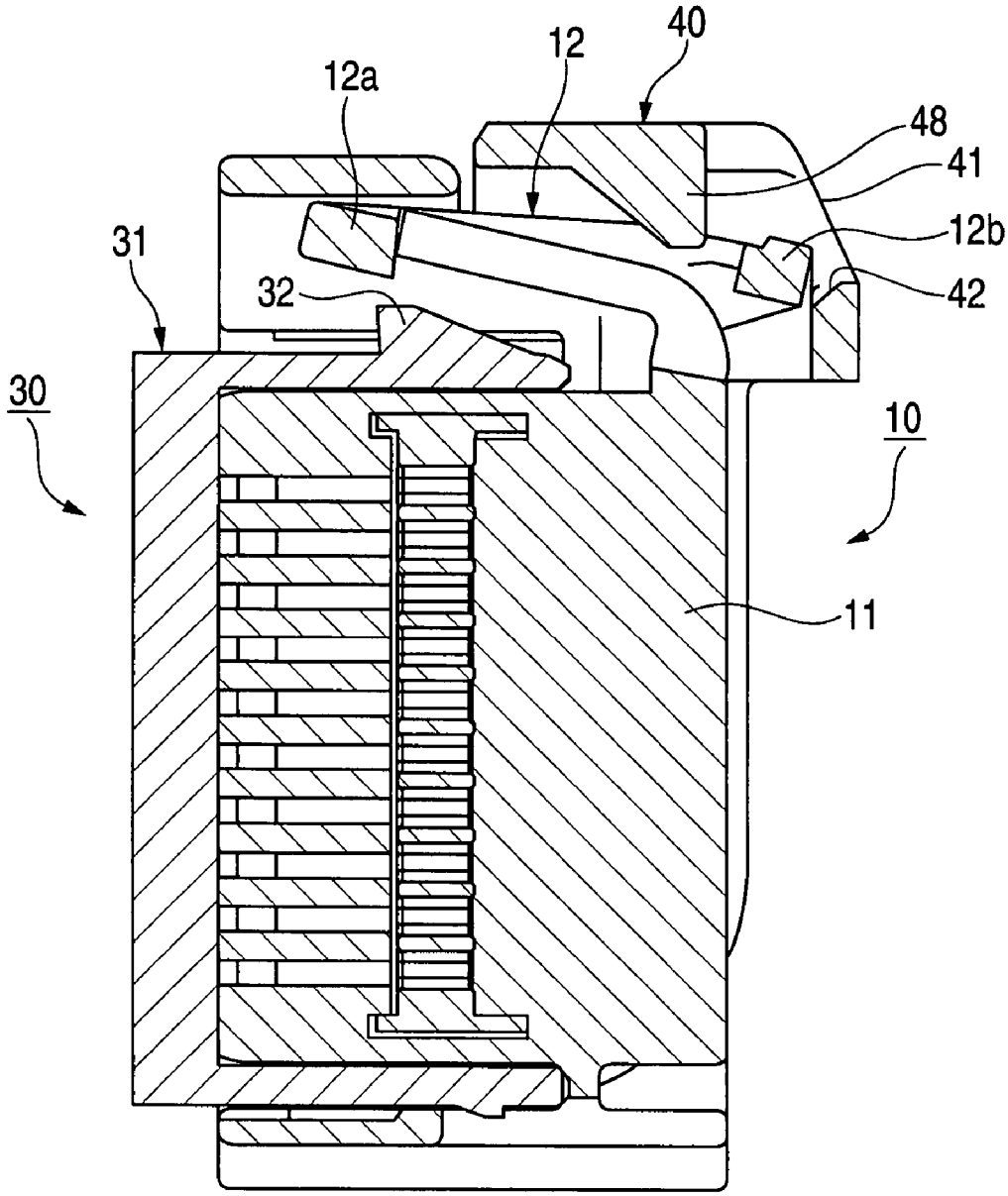
FIG. 5 is a sectional view showing a state in which the locking arm is deflected so as to cancel the fitting of the male connector in the female connector from the state shown in FIG. 3.
Figure 6:
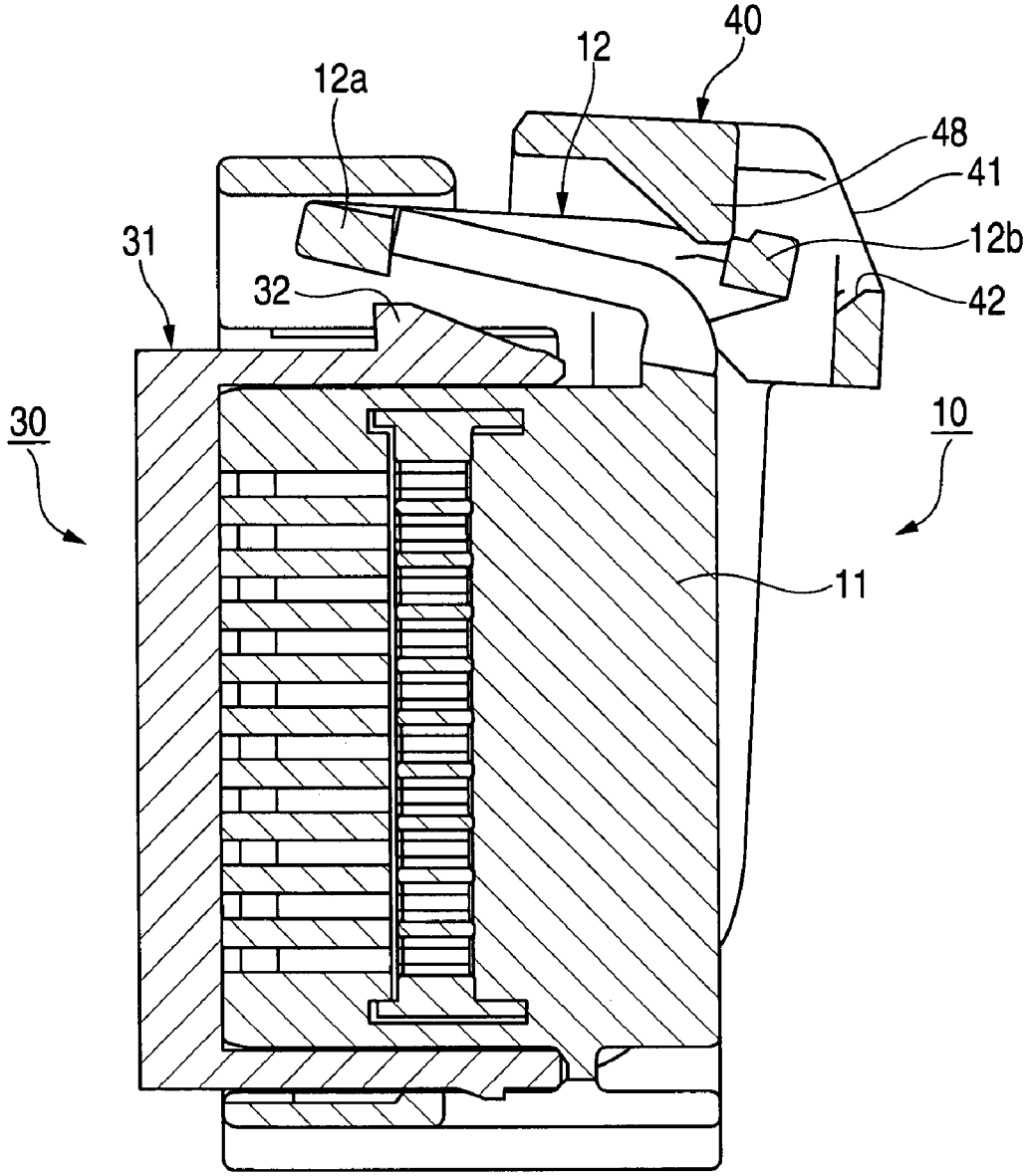
FIG. 6 is a sectional view showing a state in which the lever has been started to be rotated from the state shown in FIG. 5.

In addition, FIG. 3 is a sectional view of the connector structure shown in FIG. 1 with the cover removed therefrom and the male connector fitted in the female connector which shows a sectional view taken in a position where a locking arm becomes visible such that the lever has performed the fitting operation, FIG. 4 is a perspective view of the connector structure shown in FIG. 3, FIG. 5 is a sectional view showing a state in which the locking arm is deflected so as to cancel the fitting of the male connector in the female connector from the state shown in FIG. 3, and FIG. 6 is a sectional view showing a state in which the lever has been started to be rotated from the state shown in FIG. 5.

Figure 7:
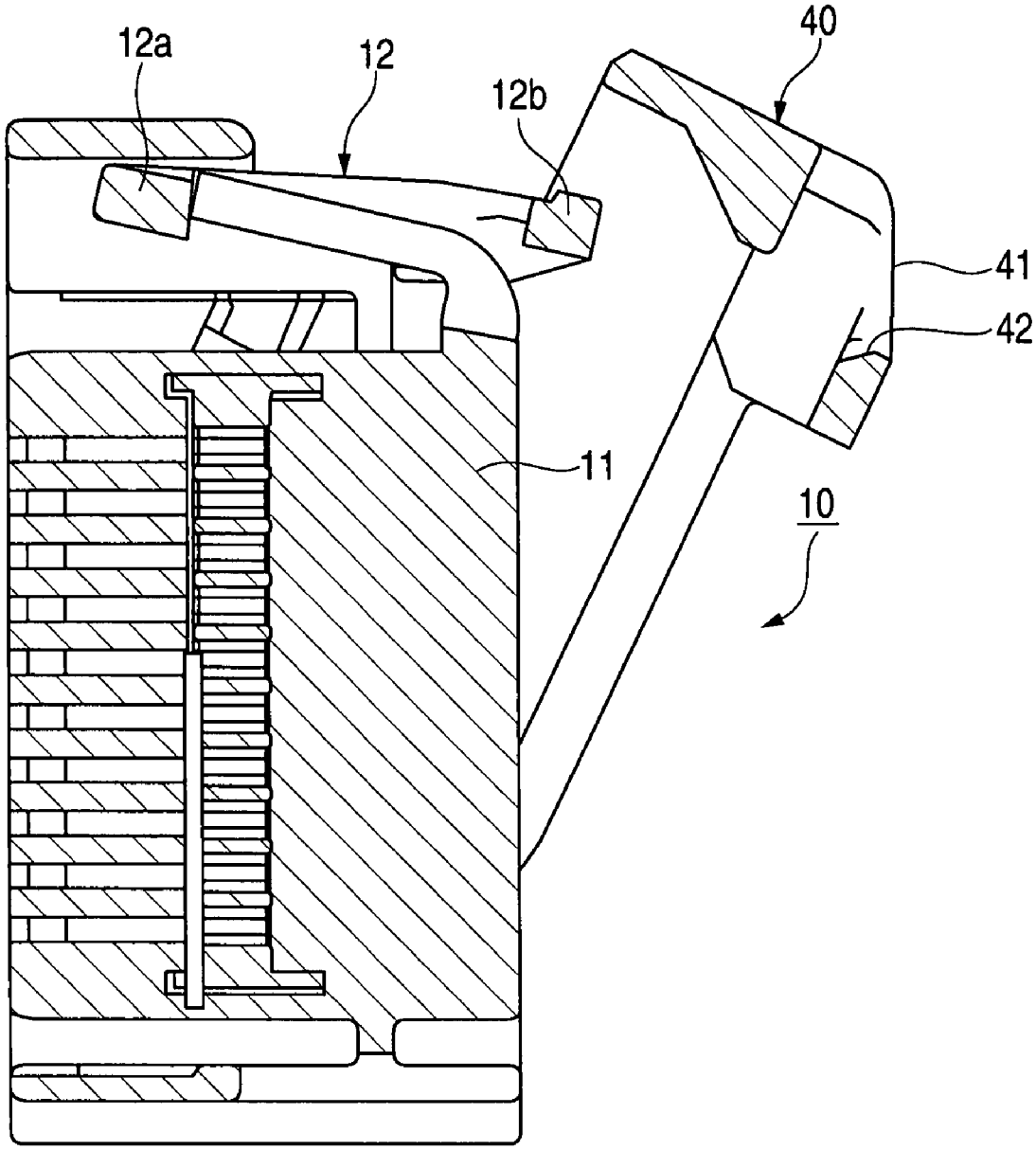
FIG. 7 is a sectional view showing the lever which has canceled the fitting of the male connector in the female connector from the state shown in FIG. 6.
Figure 8:
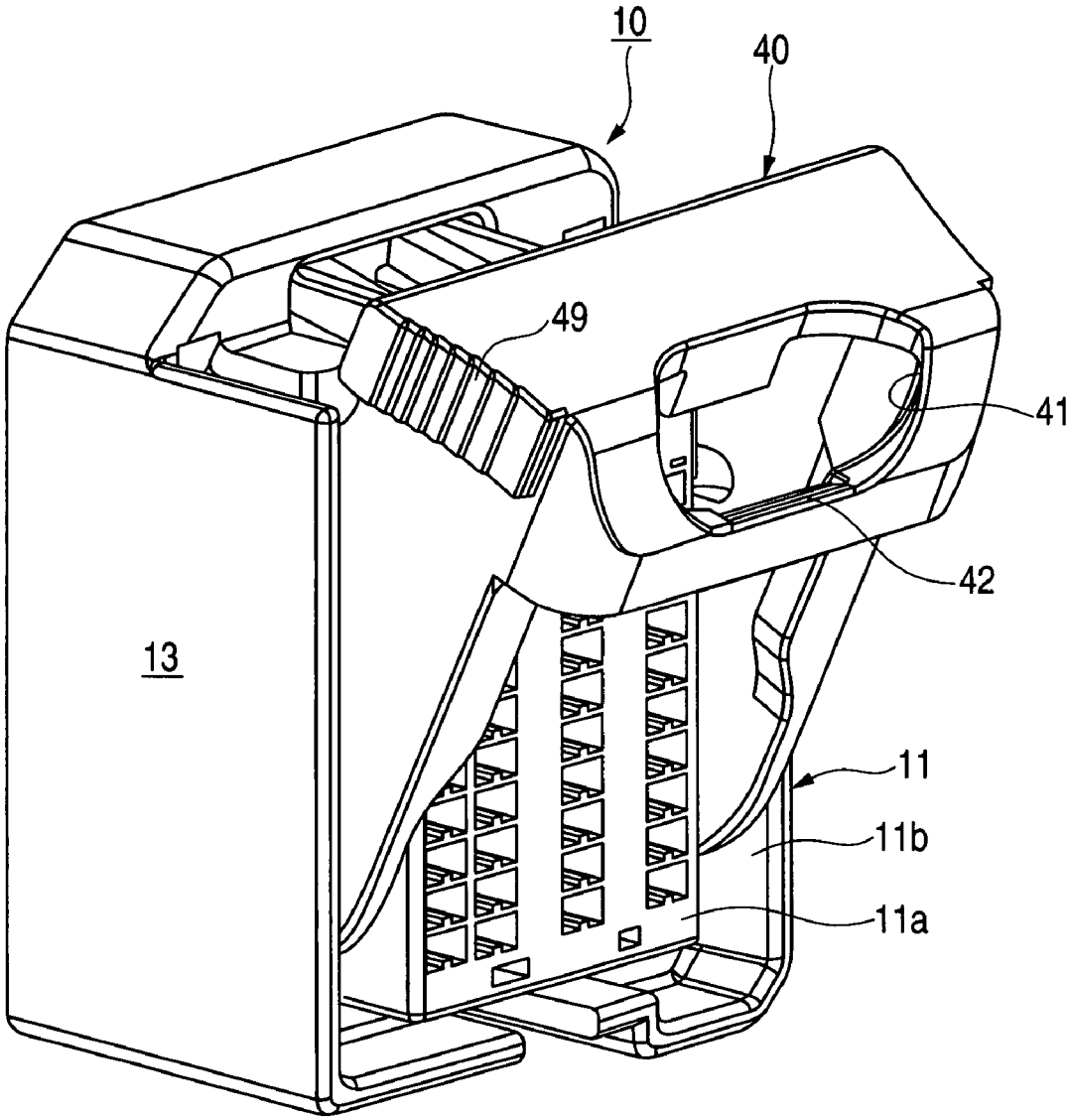
FIG. 8 is a perspective view of the connector structure in FIG. 7.
Figure 9:
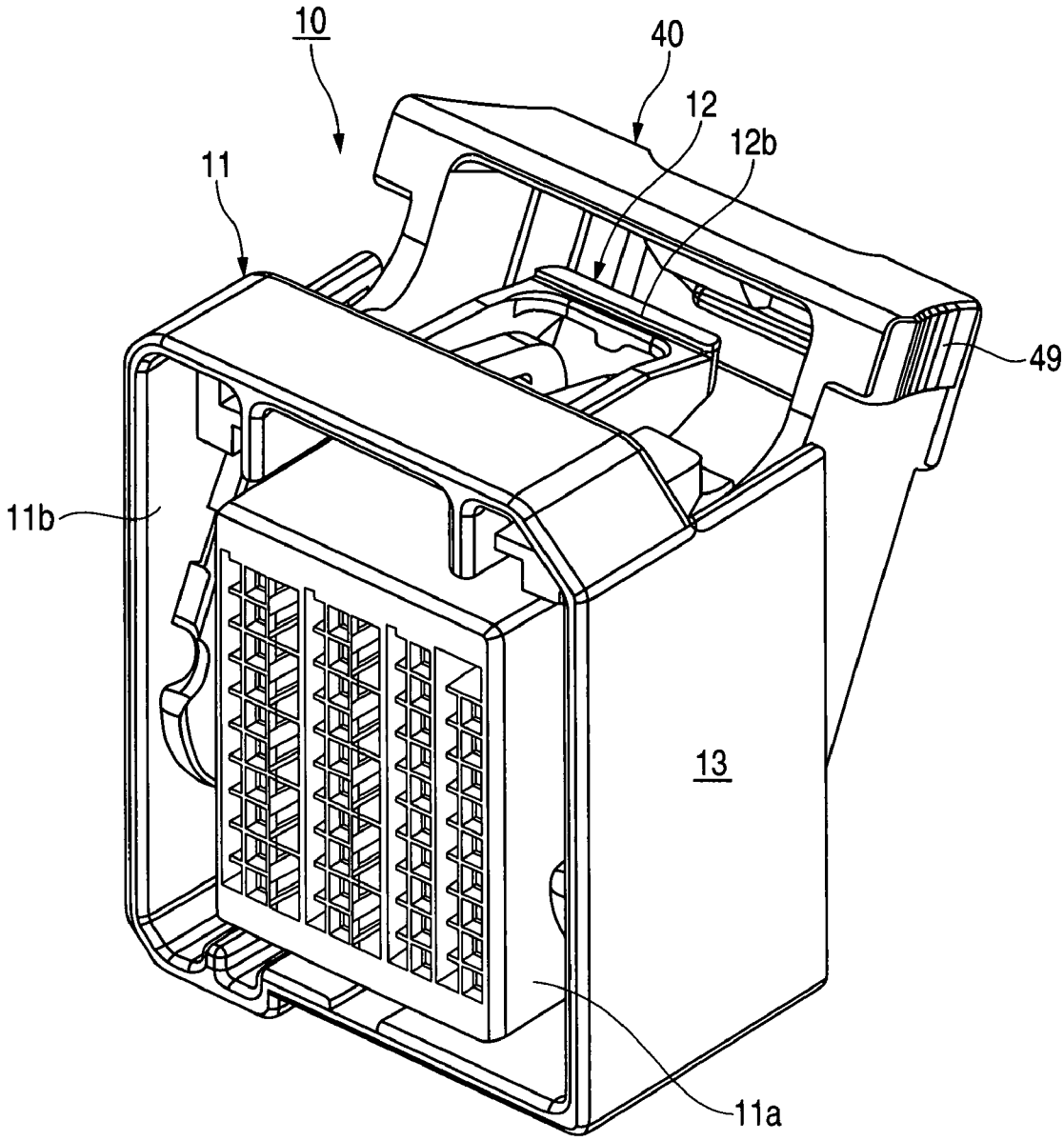
FIG. 9 is a perspective view of the connector structure in FIG. 7 which results as viewed from an opposite side to the side from which the connector structure is viewed in FIG. 8.
Figure 10:
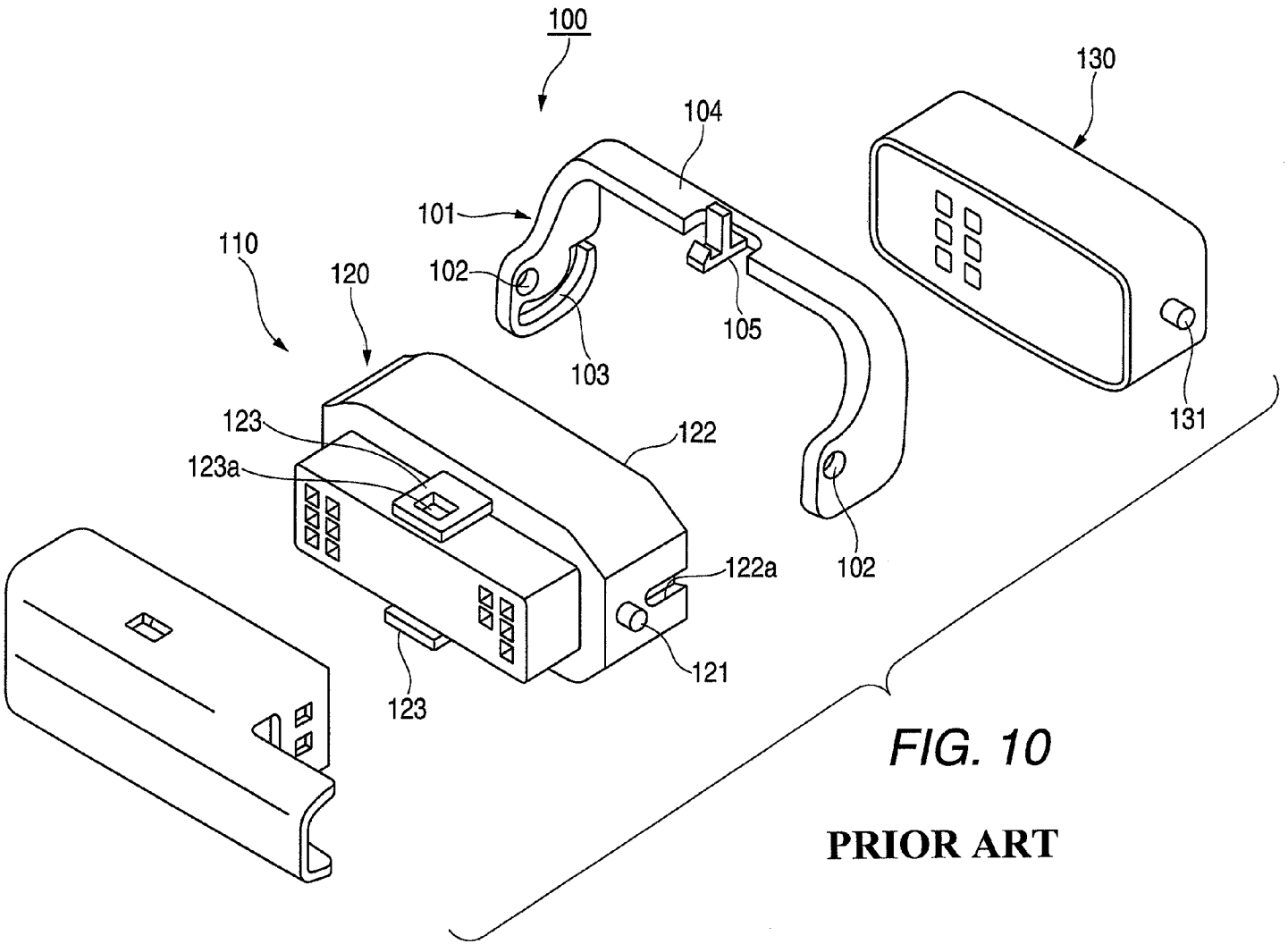
FIG. 10 PRIOR ART
FIG. 10 is an exploded perspective view of a lever type connector disclosed in Patent Document No. 1 which shows a state resulting before a male housing is fitted in a female housing.

Furthermore, FIG. 7 is a sectional view showing the lever which has canceled the fitting of the male connector in the female connector from the state shown in FIG. 6, FIG. 8 is a perspective view of the connect or structure in FIG. 7, and FIG. 9 is a perspective view of the connector structure in FIG. 7 which results as viewed from an opposite side to the side from which the connector structure is viewed in FIG. 8.

Referring to FIGS. 1 to 9, in a connector structure, a pair of female and male connectors 10, 30 are fitted together through engagement of an engagement portion 12*a* at a distal end of a locking arm 12 of the female connector 10 with an engagement projection 32 on the male connector 30. In addition, the female connector 10 and the male connector 30 are made to be drawn to and separated from each other when a fitting operation and a fitting canceling operation of the connectors 10, 30 are performed, respectively, by rotating a lever 40 which is rotatably mounted on an inner housing 11*a* of the female connector 10.

The female connector 10 has a double-wall construction in which a connector housing 11 thereof is made up of the inner housing 11*a* and an outer housing 11*b*. Terminal accommodating chambers are provided within the inner housing 11*a*, and a plurality of female terminals, not shown, are accommodated in the terminal chambers. In addition, a locking arm 12 is provided on an external surface (an upper surface as viewed in FIGS. 1 and 2) of the inner housing 11*a* of the female connector 10 in such a manner as to oscillate in a see-saw fashion about the vicinity of a longitudinal center thereof.

The locking arm 12 includes the engagement portion 12*a* which is provided at a distal end portion (a left end portion as viewed in FIG. 3) thereof and an operation access portion 12*b* which locks a lever locking projection 48 on the lever 40 side when the female and male connectors 10, 30 have completely been fitted together in association with rotation of the lever 40 and which is operated to be pressed by the tip of a finger when attempting to cancel the fitting of the connectors.

The engagement portion 12*a* of the locking arm 12 is brought into engagement with the engagement projection 32 of the male connector 30 in such a manner as to ride on a tapered portion 32*a* provided on the engagement projection 32 in association with the fitting of the male connector 30 in the female connector 10, and the fitting of the connectors 10, 30 is primarily held such that the engagement portion 12*a* has ridden over the engagement projection 32 (a state shown in FIG. 3).

The operation access portion 12*b* of the locking arm 12 is provided at a rear end portion of the locking arm 12. When the fitting of the connector housings 11, 31 of the female and male connectors 10, 30 is canceled, the operation access portion 12*b* is pressed via an opening 41 (which will be described later on) in the lever 40 by the tip of a finger or the like of the operator prior to a fitting canceling operation which occurs as a result of rotation of the lever 40, whereby the locking arm 12 is deflected to a side which causes the engagement portion 12*a* of the locking arm 12 to be raised, so as to cancel the engagement of the engagement portion 12*a* of the locking arm 12 with the engagement projection 32 of the connector housing 31 of the male connector 30.

As this occurs, the tip of the finger of the operator, which is in contact with the operation access portion 12*b* of the locking arm 12 via the opening 41 in the lever 40, is such that the finger tip is allowed to be hooked on a finger catch portion 42 for canceling locking of the lever (which will be described later on) in a natural fashion. Then, the lever 40 can be rotated by operating to rotate the lever 40 from that state as a continuous operation from the pressing operation of the operation access portion 12*b* of the locking arm 12, whereby the fitting of the female and male connectors 10, 30 can be canceled through the series of operations.

A protection wall 13 is provided on the outer housing 11*b* of the female connector 10, so as to protect the lever 40 and the locking arm 12.

The lever 40, which is formed into a portal shape as a whole, is rotatably mounted on the inner housing 11*a* of the female connector 10 and is positioned in a predetermined temporary locked position (a position shown in FIG. 1 and FIGS. 7 to 9) before the male connector 30 is fitted in the female connector 10 by being held between a housing side lever stopper 14 which is provided on the inner housing 11*a* of the female connector 10 and a cover side lever stopper 51 which is provided on a cover 50, which will be described later on.

The lever 40 includes an operating portion 43 which is disposed above the locking arm 12 and flat plate portions 44 (refer to FIG. 2) which are provided on both sides of the operating portion 43 in such a manner as to intersect the operating portion 43 substantially at right angles so as form the lever 40 into the portal shape as a whole.

The opening 41 and the lever locking canceling finger catch portion 42 are provided in the operating portion 43 of the lever 40 while being disposed in a predetermined positional relationship.

The opening 41 of the lever 40 is provided in a predetermined position which corresponds to the operation access portion 12*b* of the locking arm 12 and is positioned above the operation access portion 12*b* of the locking arm 12 in such a state as shown in FIG. 3 where the lever 40 is in an intended proper locking position, whereby the opening 41 of the lever 40 allows the finger tip of the operator to be brought into contact with the operation access portion 12*b* of the locking arm 12 so as to press the operation access portion 12*b* such that the female and male connectors 10, 30 are fitted in or on each other.

The lever locking canceling finger catch portion 42 is provided at a rear end portion of the lever 40 and is located in a position and is formed into a shape which allow the finger of the operator to be hooked thereon in a natural fashion such that the tip of the finger is in contact with (is pressing on) the operation access portion 12*b* of the locking arm 12 via the opening 41.

The lever locking projection 48 is provided on a lower surface side (a locking arm 12 side) of the operating portion 43 of the lever 40 in such a manner as to project therefrom.

In addition, the lever locking projection 48 of the lever 40 rides over the operation access portion 12*b* of the locking arm 12 so as to be locked to the operation access portion 12*b* such that the connectors 10, 30 are fitted together (refer to FIG. 3), whereby the lever 40 is made to be held in a predetermined position (refer to FIG. 3) relative to the connect or housing 11 of the female connector 10 after the completion of the fitting operation, thereby the fitting of the female and male connectors 10, 30 being held secondarily.

In addition, when the lever locking projection 48 of the lever 40 rides over the operation access portion 12*b* of the locking arm 12 so as to be locked to the operation access portion 12*b*, the locking arm 12 is such that the locking arm 12 is deflected to the side which allows the engagement portion 12*a* to be raised through engagement of the engagement portion 12*a* with the engagement projection 32, and the operation access portion 12*b* is displaced to a side where the operation access portion 12*b* interferes with the lever locking projection 48. Consequently, the lever locking projection 48 of the lever 40 can ride over the operation access portion 12*b* of the locking arm 12 in a smooth fashion.

A fitting groove 45 through which an application point boss 15 (which will be described later on) of the female connector 10 is fittingly passed, a guide groove 46 through which a lever rotation guide boss 16 (which will be described later on) of the female connector 10 is fittingly passed, a temporary locking arm 47 which positions the lever 40, a projecting fulcrum (not shown) and a lever proper locking finger catch portion 49 are provided on each of the flat plate portions 44 of the lever 40, the projecting fulcrum lying on an internal side (a inner housing 11*a* side) of the flat plate portion 44.

The application point boss 15 which is provided on an internal surface of the outer housing 11*b* of the female connector 10 in such a manner as to project therefrom is fittingly passed through the fitting groove 45 of the lever 40 in such a manner as to slide therealong. Namely, the fitting groove 45 allows the application point boss 15 to slide and be guided therealong in association with rotation of the lever 40, so that the application point boss 15 is allowed to function as a rotating fulcrum of the lever 40 relative to the inner housing 11*a* of the female connector 10.

The lever rotation guide boss 16 which is provided on the internal surface of the outer housing 11*b* of the female connector 10 in such a manner as to project thereof is fittingly passed through the guide groove 46 of the lever 40 in such a manner as to slide therealong. Namely, the guide groove 46 allows the lever rotation guide boss 16 to slide and be guided therealong in association with rotation of the lever 40, so as to restrict a rotating locus of the lever 40.

The temporary locking arm 47 of the lever 40 is brought into engagement with the housing side lever stopper 14 which is provided on an external surface of the inner housing 11*a* of the female connector 10 in such a manner as to project therefrom to thereby interrupt the rotation of the lever 40 in a predetermined position.

The fulcrum of the lever 40 is fitted in a fulcrum guide portion 33 of the male connector 30, which will be described later on, in association with the fitting of the male connector 30 in the female connector 10, and slides and is guided within the fulcrum guide portion 33 in association with rotation of the lever 40, whereby the fulcrum of the lever 40 is made to function as the rotating fulcrum of the lever 40 relative to the connector housing 31 of the male connector 30.

Namely, the lever 40 is rotated in a predetermined rotating locus about the application point boss 15 which is passed through the fitting groove 45 relative to the inner housing 11*a* of the female connector 10 and about the fulcrum which is fitted in the fulcrum guide portion 33 of the male connector 30 relative to the connector housing 31 of the male connector 30 while being guided relative to the inner housing 11*a* of the female connector 10 by the lever rotation guide boss 16 which is passed through the guide groove 46, whereby the lever is made to be rotated with a small rotating radius, and the rotating stability thereof is secured.

The lever proper locking finger catch portion 49 of the lever 40 has a surface which is formed into a slippage preventive configuration, so as to prevent the occurrence of slippage between the finger tip of the operator and the lever 40 when the female and male connectors 10, 30 are fitted together, whereby a smooth and ensured operability of the lever 40 is secured.

Terminal accommodation chambers are provided within the connector housing 31 of the male connector 30, and a plurality of male terminals are accommodated in the terminal accommodation chambers. In addition, the engagement projection 32 is provided on an upper surface, as viewed in FIG. 1, of the connector housing 31 of the male connector 30, and fitting guide ribs 34 are provided on both sides of the engagement projection 32. Furthermore, a temporary locking canceling rib 35 and the fulcrum guide portion 33 are provided on each side surface, as viewed in FIG. 1, of the connector housing 31 of the male connector 30.

The engagement projection 32 of the male connector 30 is brought into engagement with the engagement portion 12*a* of the locking arm 12 of the female connector 10 in association with the fitting of the male connector 30 in the female connector 10, whereby the fitting of the female and male connectors 10, 30 is primarily held.

The fitting guide ribs 34 of the male connector 30 restrict a traveling locus of the connector housing 31 of the male connector 30 relative to the inner housing 11*a* of the female connector 10 when the male connector 30 is fitted in the female connector 10.

The temporary locking canceling rib 35 of the male connector 30 is brought into engagement with the temporary locking arm 47 of the lever in association with the fitting of the male connector 30 in the female connector 10, so as to deflect the temporary locking arm 47 transversely outwards, whereby the engagement of the temporary locking arm 47 with the housing side lever stopper 14 (the temporarily locked state) is canceled, bringing the lever 40 into a rotatable state.

The fulcrum of the lever 40 is fitted in the guide portion 33 of the male connector 30 in association with fitting of the male connector 30 in the female connector 10 and is then allowed to slide and be guided therealong in association with rotation of the lever 40, whereby the fulcrum guide portion 33 makes the fulcrum of the lever 40 function as the rotating fulcrum of the lever 40 relative to the connector housing 31 of the male connector 30.

The cover 50 is fitted over the inner housing 11*a* of the female connector 10. The cover 50 is formed into a shape having a substantially U-shaped cross section and protects electric wires which are laid to extend from a rear end of the inner housing 11*a* of the female connector 10.

A pair of lever guide ribs 52 are provided on an upper surface, as viewed in FIG. 1, of the cover 50, and the cover side lever stopper 51 is provided on a surface of a side of the cover 50 as viewed in FIG. 1.

The lever guide ribs 52 of the cover 50 guide the lever 40 and restrict the rotating locus of the lever when the lever 40 rotates, so as to secure the rotating stability of the lever 40, whereby the fitting operation and fitting canceling operation of the female and male connectors 10, 30 which occur in association with the operation of the lever 40 are implemented in an ensured fashion.

In addition, the cover side lever stopper 51 on the cover 50 prevents the rotation of the lever 40 and positions the lever 40 in the predetermined position by holding the lever 40 between the housing side lever stopper 14 and itself.

Thus, according to the embodiment, the lever 40, which is mounted on the inner housing 11*a* of the female connector 10, performs the fitting operation and fitting canceling operation of the female and male connectors 10, 30 in association with rotation thereof, whereby the fitting and fitting cancellation of the female and male connectors 10, 30 can be implemented with a low insertion force.

In addition, the opening 41 in the lever 40 allows the finger tip of the operator to be brought into contact with the operation access portion 12*b* of the locking arm 12 so as to press the operation access portion 12*b* such that the female and male connectors 10, 30 are fitted together, and the lever locking canceling finger catch portion 42 in the lever 40 is located in the position and formed into the shape which allow the finger to be hooked thereon in the natural fashion such that the finger tip of the operator is in contact with the operation access portion 12*b* of the locking arm 12 via the opening 41.

Consequently, the pressing (fitting canceling) operation of the locking arm 12 is allowed to be implemented via the opening 41 in the lever 40, and the lever 40 is allowed to be rotated smoothly through operation of the lever locking canceling finger catch portion 42 as a continuous operation from the relevant operation access portion pressing operation, thereby making it possible to perform a disconnecting operation of the female and male connectors 10, 30. Namely, the pressing (fitting canceling) operation of the locking arm 12 and rotating operation of the lever 40 by the finger tip of the operator can be performed smoothly and in an ensured fashion as the series of operations.

By this configuration, the connector fitting with low insertion force is enabled by the lever 40, and even though the failure of the lever 40 or the like happens, the fitting of the female and male connectors 10, 30 can be held by the locking arm 12. On the other hand, the operating procedure of the female and male connectors 10, 30 when the fitting thereof is canceled can be simplified, and the failure to follow the operating procedure which would otherwise occur due to it becoming complicated and troublesome and the failure of the locking arm 12 or the like which would otherwise occur in association with the failure to follow the operating procedure can be prevented in an ensured fashion.

The connector structure that can be obtained by the invention is preferably applied when attempting to realize the connector fitting with low insertion force by the lever, the ensured holding of the fitting of the female and male connectors by the locking arm and the simplification of the operating procedure when the fitting of the female and male connectors is canceled.

What is claimed is:

1. A connector structure comprising:

a first connector including a locking arm having an engagement portion; and a second connector including an engagement projection, wherein housings of the first and second connectors are fitted together through engagement of the engagement portion with the engagement projection, wherein a lever rotatably provided on the connector housing of the first connector to perform a fitting operation and a fitting canceling operation in association with rotation thereof, an operation access portion is provided on the locking arm which is to be pressed to deflect the locking arm so that the engagement portion is released from the engagement projection, and the operation access portion is disposed in a position such that the operation access portion is able to be pressed to release the engagement portion from the engagement projection prior to the rotation of the lever associated with the fitting canceling operation and the rotating operation of the lever can be subsequently performed continuously.

2. The connector structure according to claim 1, wherein an opening is provided on the lever in a predetermined position which corresponds to the operation access portion on the locking arm, so that the operation access portion is pressed via the opening prior to the fining canceling operation in association with the rotation of the lever.

3. The connector structure according to claim 1, wherein a finger catch portion for canceling locking of the lever is provided on the lever, and the finger catch portion is formed into a predetermined shape at a predetermined position so that a finger of an operator is hooked thereon while a tip of the finger is in contact with the operation access portion of the locking arm.

4. The connector structure according to claim 1, wherein the level is provided with a locking lever projection which is locked by the operation access portion when the first connector and the second connector are fitted together.

* * * * *